United States Patent [19]

Fendley

[11] Patent Number: 4,728,854

[45] Date of Patent: Mar. 1, 1988

[54] UNDULATING SUPPORT STRUCTURE FOR TENSION SHADOW MASK

[75] Inventor: James R. Fendley, Arlington Heights, Ill.

[73] Assignee: Zenith Electronics Corporation, Glenview, Ill.

[21] Appl. No.: 925,656

[22] Filed: Oct. 29, 1986

[51] Int. Cl.[4] ..... H01J 29/07

[52] U.S. Cl. ..... 313/407; 313/408

[58] Field of Search ..... 313/402, 407, 408

[56] References Cited

U.S. PATENT DOCUMENTS

| | | | |
|---|---|---|---|
| 2,625,734 | 1/1953 | Law | 29/25.13 |
| 2,733,366 | 1/1956 | Grimm et al. | 313/85 |
| 2,761,990 | 9/1956 | Amdursky et al. | 313/70 |
| 2,813,213 | 11/1957 | Cramer et al. | 313/78 |
| 2,842,696 | 7/1958 | Fischer-Colbrie | 313/78 |
| 2,905,845 | 9/1959 | Vincent | 313/78 |
| 3,030,536 | 4/1962 | Hackett et al. | 313/80 |
| 3,284,655 | 6/1963 | Oess | 313/286 |
| 3,638,063 | 1/1972 | Tachikawa et al. | 313/348 |
| 3,727,087 | 4/1973 | Steinberg | 313/91 |
| 3,894,321 | 7/1975 | Moore | 29/25.15 |
| 4,045,701 | 8/1977 | Dougherty | 313/408 |
| 4,069,567 | 1/1978 | Schwartz | 29/25.15 |
| 4,087,717 | 5/1978 | Lerner | 313/406 |
| 4,100,451 | 7/1978 | Palac | 313/404 |
| 4,146,816 | 3/1979 | Morrell | 313/407 |
| 4,547,696 | 10/1985 | Strauss | 313/407 |

OTHER PUBLICATIONS

"The CBS-Colortron: A Color Picture Tube of Advanced Design", N. F. Fyler, W. E. Rowe, C. W. Cain.

"A High-Brightness Shadow Mask Color CRT for Cockpit Displays", Robinder, Bates, Green, Lewen and Rath, Tektronix, Inc., Beaverton, OR.

*Primary Examiner*—David K. Moore

*Assistant Examiner*—Sandra L. O'Shea

*Attorney, Agent, or Firm*—Cornelius J. O'Connor

[57] ABSTRACT

An improved front assembly for a color cathode ray tube having a tension foil shadow mask is disclosed. The faceplate of the tube has on its inner surface a centrally disposed phosphor screen surrounded by a peripheral sealing area adapted to mate with a funnel. A shadow mask support structure is secured to the faceplate for securing a shadow mask in tension on the structure and spacing the shadow mask from the screen. The support structure includes an undulated member defining peaks and valleys. The valleys are flattened in a common plane and provide means for securing the support structure to the faceplate. The peaks are flattened in a common plane and provide means for securing the shadow mask to the support structure.

20 Claims, 8 Drawing Figures

UNDULATING SUPPORT STRUCTURE FOR TENSION SHADOW MASK

CROSS-REFERENCE TO RELATED APPLICATIONS

This application is related to but in no way dependent upon copending applications Ser. No. 832,493, filed Feb. 21, 1986; Ser. No. 831,699, filed Feb. 21, 1986; Ser. No. 832,556, filed Feb. 21, 1986; Ser. No. 835,845, filed Mar. 3, 1986; and Ser. No. 866,030, filed May 21, 1986, all of common ownership herewith.

FIELD OF THE INVENTION

This invention generally relates to color cathode ray picture tubes and, specifically, to a novel front assembly for color tubes that have a tension foil shadow mask. The invention is useful in color tubes of various types including those used in home entertainment television receivers, and those used in medium-resolution and high-resolution tubes intended for color monitors.

BACKGROUND OF THE INVENTION

The use of the tension foil mask and a flat faceplate provides many advantages and benefits in comparison with the conventional curved or domed shadow mask. Chief among these is a greater power-handling capability which makes possible as much as a three-fold increase in brightness. The conventional curved shadow mask, which is not under tension, tends to "dome" in high-brightness picture areas where the intensity of electron bombardment is greatest. Color impurities result as the mask moves closer to the faceplate. Being under high tension, the tension foil mask does not dome or otherwise move in relation to the faceplate. Therefore, it has greater brightness potential while maintaining color purity.

The tension foil shadow mask is a part of the cathode ray tube front assembly, and is located in close adjacency to the faceplate. The front assembly comprises the faceplate with its deposits of light-emitting phosphors, a shadow mask, and support means for the mask. As used herein, the term "shadow mask" means an apertured metallic foil which may have a thickness, by way of example, of about one mil or less. The mask must be supported in high tension a predetermined distance from the inner surface of the cathode ray tube faceplate. This distance is known as the "Q-distance." The high tension may be in the range of 20 to 40 kpsi. As is well known in the art, the shadow mask acts as a color-selection electrode, or parallax barrier, which ensures that each of the three color beams lands only on it assigned phosphor deposits.

The requirements for the support means for the shadow mask are stringent. As has been noted, the shadow mask must be mounted under high tension. The mask support means must be of high strength so that the mask is held immovable. An inward movement of the mask of as little as one-tenth of a mil is significant in that guard band may be expended. Also, the shadow mask support means must be of such configuration and material composition as to be compatible with the means to which it is attached. As an example, if the support means is attached to glass such as the inner surface of the faceplate, the support means must have about the same thermal coefficient of expansion as that of the glass. The support means must provide a suitable surface for mounting the mask. Also, the support means must be of a composition such that the mask can be welded onto it by electrical resistance welding or by laser welding. The support surface preferably is of such flatness that no voids can exist between the metal of the mask and the support structure to prevent the intimate metal-to-metal contact required for proper welding.

A tension mask registration and supporting system is disclosed by Strauss in U.S. Pat. No. 4,547,696 of common ownership herewith. A frame dimensioned to enclose the screen comprises first and second space-apart surfaces. A tensed foil shadow mask has a peripheral portion bonded to a second surface of the frame. The frame is registered with the faceplate by ball-and-groove indexing means. The shadow mask is sandwiched between the frame and a stabilizing or stiffening member. When the system is assembled, the frame is located between the sealing lands of the faceplate and a funnel, with the stiffening member projecting from the frame into the funnel. While the system is feasible and provides an effective means for holding a mask under high tension and rigidly planoparallel with a flat faceplate, weight is added to the cathode ray tube, and additional process steps are required in manufacture.

There exists in the marketplace today a color tube that utilizes a tensed shadow mask. The mask is understood to be placed under high tension by purely mechanical means. Specifically, a very heavy mask support frame is compressed prior to and during affixation of the mask to it. Upon release of the frame, restorative forces in the frame cause the mask to be placed under high residual tension. During normal tube operation, electron beam bombardment causes the mask to heat up and the mask tension to be reduced. An upper limit is placed on the intensity of the electron beams that may be used to bombard the screen without causing the mask to relax completely and lose its color selection capability. The upper limit has been found to be below that required to produce color pictures of the same brightness as are produced in tubes having non-tensed shadow masks. For descriptions of examples of this type of tube, see U.S. Pat. No. 3,683,063 to Tachikawa.

Other prior art include: Lerner—U.S. Pat. No. 4,087,717; Dougherty—U.S. Pat. No. 4,045,701; Palac—U.S. Pat. No. 4,100,451; Law—U.S. Pat. No. 2,625,734; Steinberg et al—U.S. Pat. No. 3,727,087; Schwartz—U.S. Pat. No. 4,069,567; Moore—U.S. Pat. No. 3,894,321; Oess—U.S. Pat. No. 3,284,655; Hackett—U.S. Pat. No. 3,303,536; Hackett et al—U.S. Pat. No. 3,030,536; Vincent—U.S. Pat. No. 2,905,845; Fischer-Colbrie—U.S. Pat. No. 2,842,696; Law—U.S. Pat. No. 2,625,734; a journal article: "The CBS Colortron: A color picture tube of advanced design." Fyler et al. Proc. of the IRE, January 1954. Dec. class R583.6; and a digest article: "A High-Brightness Shadow-Mask Color CRT for Cockpit Displays." Robinder et al. Society for Information Display, 1983.

OBJECTS OF THE INVENTION

A general object of the invention is to provide an improved front assembly for tension foil shadow mask tubes.

Another general object of the invention is to provide a tension foil shadow mask support structure that is low in cost and light in weight.

A further object of the invention is to provide a tension foil shadow mask support structure that can be mounted on a faceplate for receiving a tension foil shadow mask.

Still another object of the invention is to provide a tension foil shadow mask support structure that is capable of holding a tension foil shadow mask firmly in registration under high electron beam bombardment.

Yet a further object of the invention is to provide a tension foil shadow mask support structure that simplifies manufacture and lowers manufacturing costs.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the figures of which like reference numerals identify like elements, and in which:

DESCRIPTION OF THE PREFERRED EMBODIMENT

Figure 1:
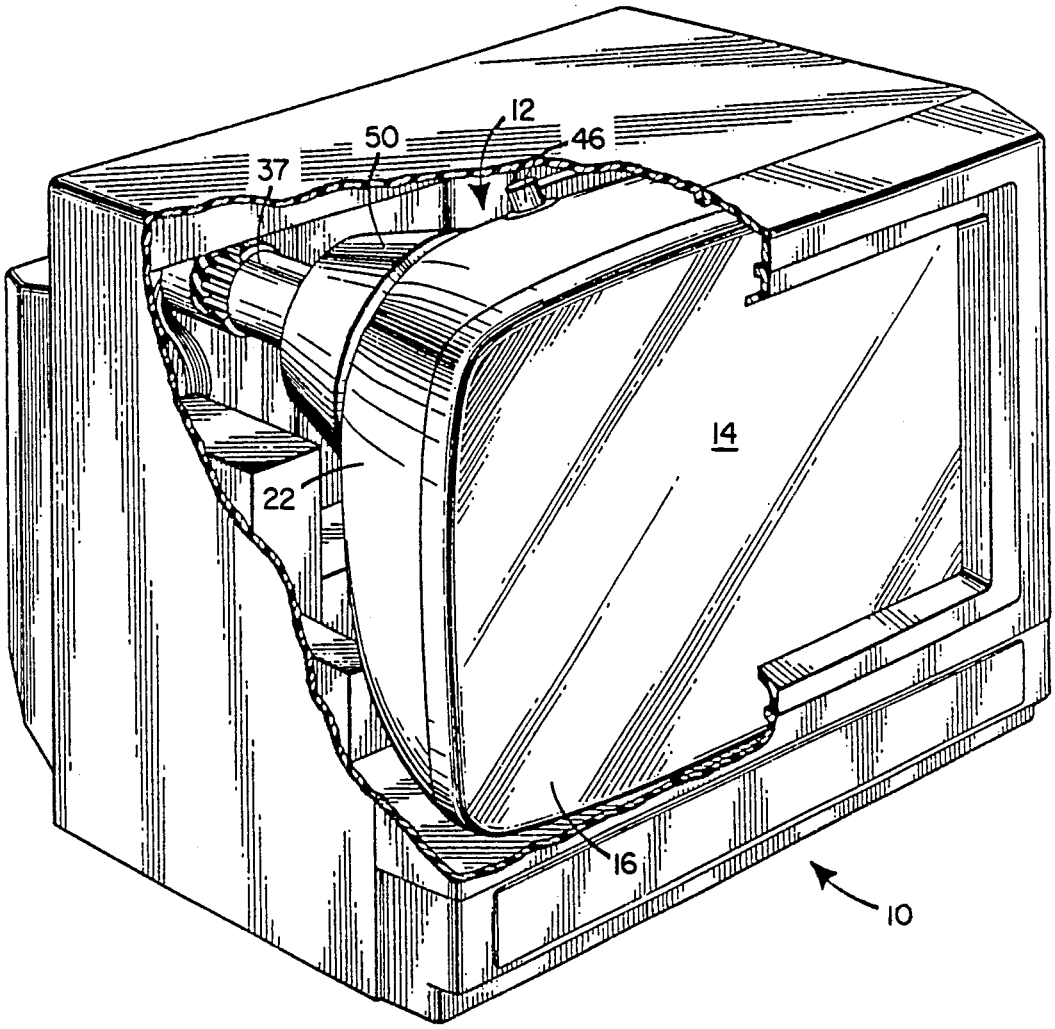
FIG. 1 is a cut-away perspective view of a cabinet housing a cathode ray tube having a front assembly according to the invention.

FIG. 1 depicts a video monitor, generally designated 10, that houses a color cathode ray tube, generally designated 12, having a novel front assembly according to the invention. The design of the video monitor is the subject of copending design patent application Ser. No. 725,040 of common ownership herewith. The monitor-associated tube is notable for the flat imaging area 14 that makes possible the display of images in undistorted form. Imaging area 14 also offers a more efficient use of screen area as the corners are relatively square in comparison with the more rounded corners of the conventional cathode ray tube. The front assembly according to the invention comprises the components described in the following paragraphs.

Figure 2:
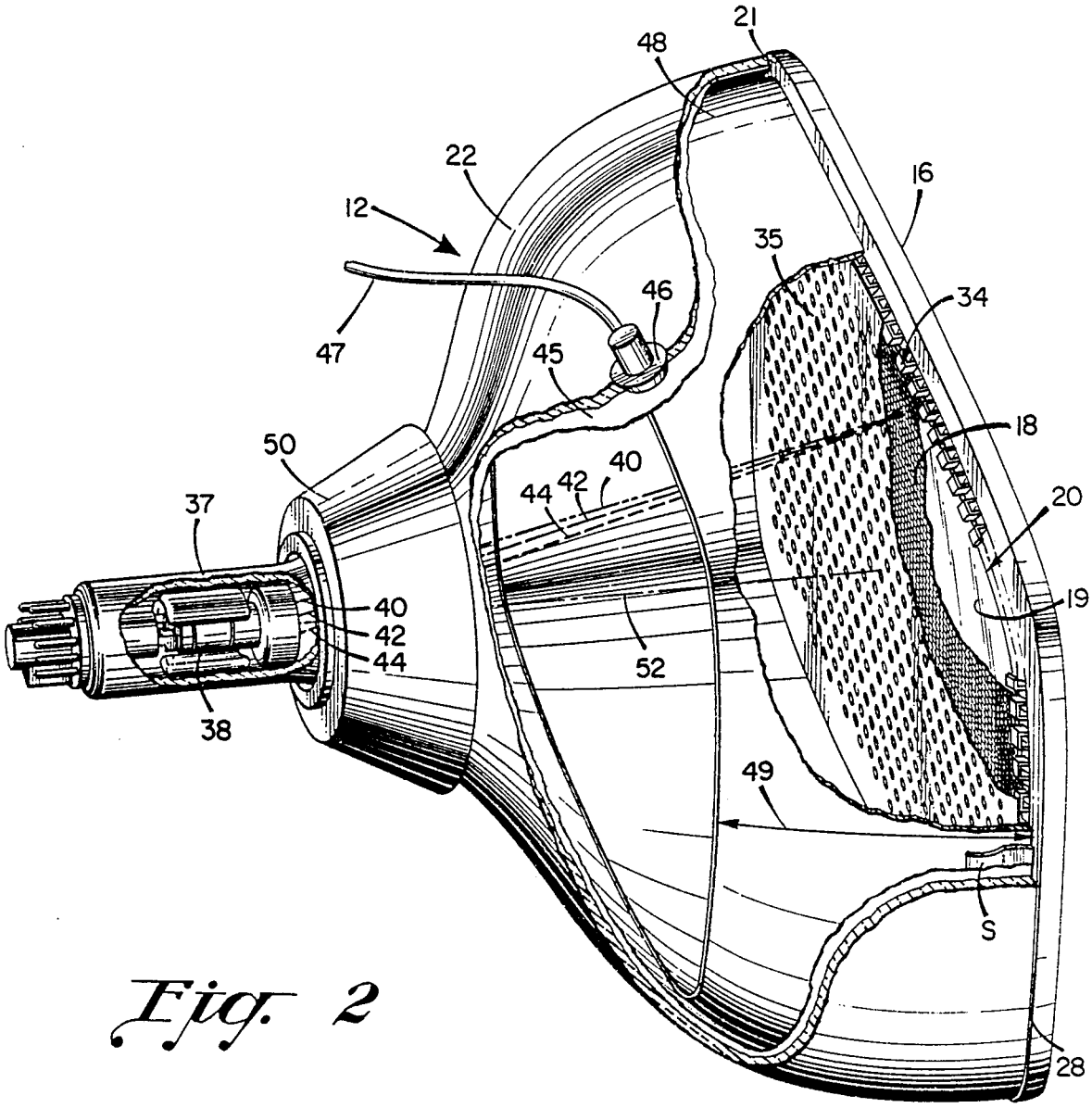
FIG. 2 is a cut-away side perspective view of the color cathode ray tube of FIG. 1, illustrating the location of the shadow mask support structure incorporating the concepts of the invention.
Figure 3:
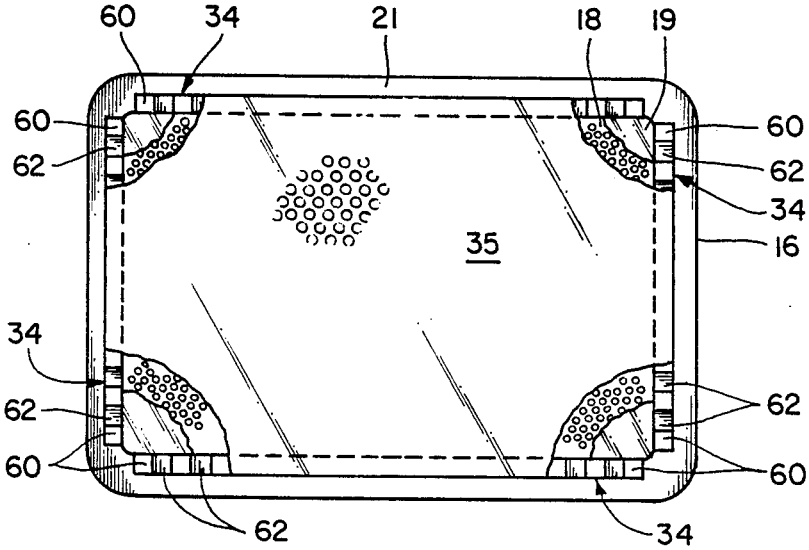
FIG. 3 is a plan view showing the relationship of the shadow mask support structure to the inner surface of the cathode ray tube faceplate shown in FIG. 2.
Figure 8:
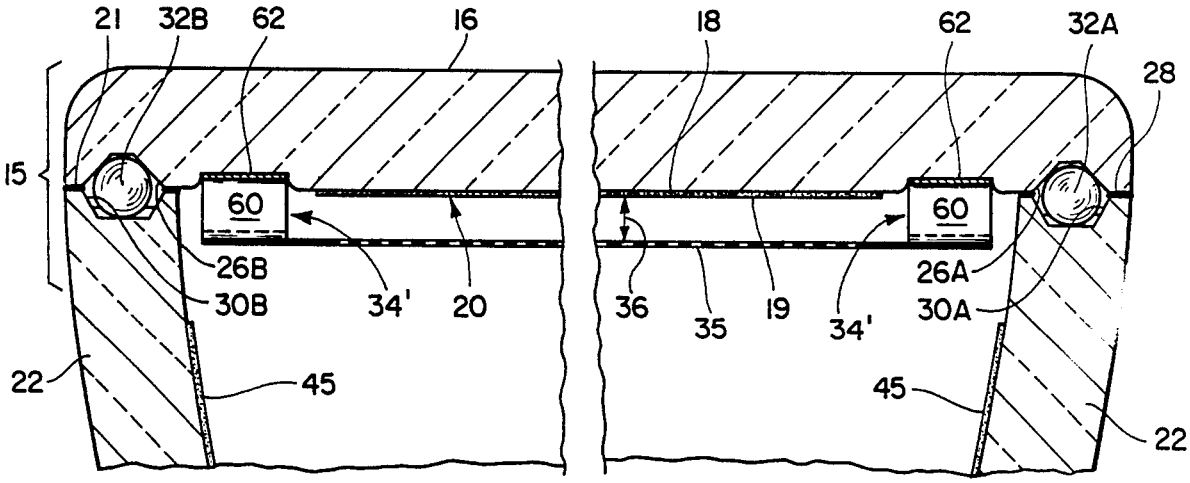
FIG. 8 is an axial section through the front assembly of the color cathode ray tube.

With reference also to FIGS. 2, 3 and 8, a front assembly 15 (FIG. 8) for a high-resolution color cathode ray tube is depicted, the general scope of which is indicated by the bracket. Front assembly 15 includes a glass faceplate 16 noted as being flat, or alternately, "substantially" flat in that it may have finite horizontal and vertical radii. Faceplate 16, depicted in this embodiment of the invention as being planar and flangeless, has on its inner surface a centrally disposed phosphor target area 18, on which is deposited an electrically conductive film 19. Phosphor target area 18 and conductive film 19 comprise the electron beam target area, commonly termed a "screen," generally designated 20, which serves, during manufacture, for receiving a uniform coat of phosphor slurry. Conductive film 19, which is deposited on the phosphor deposits in a final step, typically consists of a very thin, light-reflective, electron-pervious film of aluminum.

Screen 20 is surrounded by a peripheral sealing area 21 adapted to be mated with a funnel 22. Sealing area 21 is represented as having three substantially radially oriented first indexing V-grooves therein, only two grooves 26A and 26B being shown in FIG. 8. The indexing grooves preferably are peripherally located at equal angular intervals about the center of faceplate 16; that is, at 120-degree intervals. Indexing grooves 26A and 26B are shown in FIG. 8. The third indexing groove is not shown; however, it is also located in peripheral sealing area 21 equidistantly from indexing elements 26A and 26B. The V-shaped indexing grooves provide for indexing faceplate 16 in conjunction with a mating envelope member, as will be shown.

Figure 4:
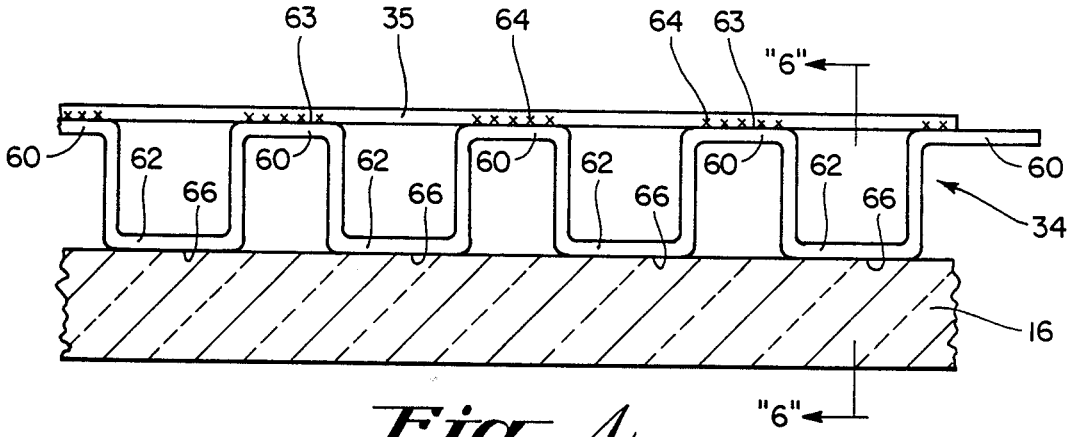
FIG. 4 is a fragmented elevational view of the tension mask support structure of the invention mounted on a section of the faceplate, with the tension mask welded thereto.

Funnel 22 has a funnel sealing area 28 with second indexing elements or grooves 30A and 30B therein in like orientation, and depicted in FIG. 4 in facing adjacency with the first indexing elements 26A and 26B. Ball means 32A and 32B, which provide complementary rounded indexing means, are conjugate with the indexing grooves or elements 26A and 26B and 30A and 30B for registering the faceplate 16 and the funnel 22. The first indexing elements together with the ball means are also utilized as indexing means during the photoscreening of the phosphor deposits on the faceplate.

Front assembly 15 according to the invention includes a tension foil mask support structure, generally designated 34, secured to the inner surface of faceplate 16 between screen 20 and peripheral sealing area 21 and enclosing the phosphor target 18. The support structure provides for supporting a tension foil shadow mask 35 a predetermined "Q-distance" from the inner surface of faceplate 16. The predetermined distance may comprise the "Q-distance" 36, as indicated by the associated arrow in FIG. 8. The mask, indicated as being planar, is depicted as being stretched in all directions in the plane of the mask.

As seen in FIG. 2, a neck 37 extending from funnel 22 is represented as housing as electron gun 38 which is indicated as emitting three electron beams 40, 42 and 44 that selectively activate phosphor target 18, noted as comprising colored-light emitting phosphor deposits overlayed with a conductive film 19. Beams 40, 42 and 44 serve to selectively activate the pattern of phosphor deposits after passing through the parallax barrier formed by shadow mask 35.

Funnel 22 is indicated as having an internal electrically conductive funnel coating 45 adapted to receive a high electrical potential. The potential is depicted as being applied through an anode button 46 attached to a conductor 47 which conducts a high electrical potential to the anode button 46 through the wall of funnel 22. The source of the potential is a high-voltage power supply (not shown). The potential may be, for example, in the range of 18 to 26 kilovolts in the illustrated monitor application. Means for providing an electrical connection between the electrically conductive support structure 34 and funnel coating 45 may comprise spring means "S" (depicted in FIG. 2).

A magnetically permeable internal magnetic shield 48 is shown as being attached to support structure 34. Shield 48 extends into funnel 22 a predetermined distance 49 which is calculated so that there is no interference with the excursion of the electron beams 40, 42 and 44, yet maximum shielding is provided.

A yoke 50 is shown as encircling tube 12 in the region of the junction between funnel 22 and neck 37. Yoke 50 provides for the electromagnetic scanning of beams 40, 42 and 44 across the screen 20. The center axis 52 of tube 12 is indicated by the broken line.

Figure 5:
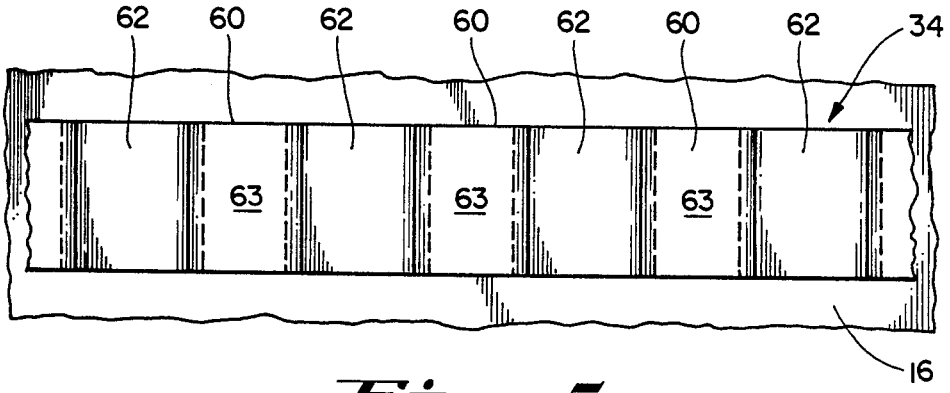
FIG. 5 is a fragmented plan view of the support structure, with the tension mask removed to facilitate the illustration.
Figure 6:
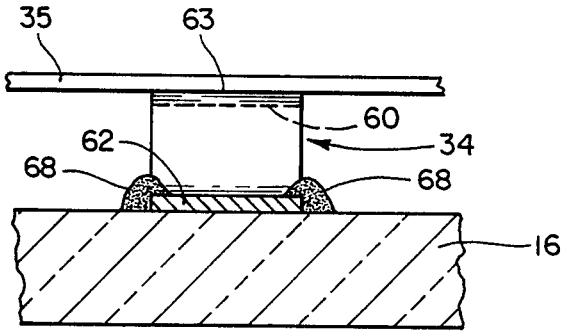
FIG. 6 is a fragmented section taken generally along line 6—6 of FIG. 4.
Figure 7:
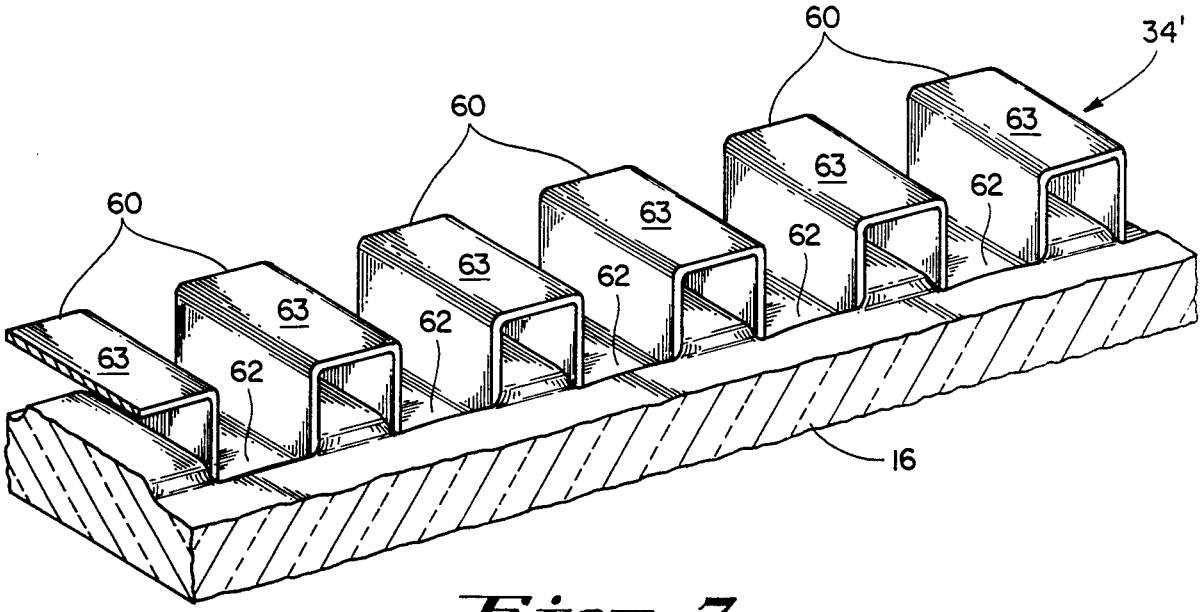
FIG. 7 is a fragmented perspective view of the support structure, illustrating an alternate form of securing the support structure to the faceplate.

FIGS. 4–6 show one embodiment of tension foil shadow mask support structure 34, and FIGS. 7 and 8 show an alternate form of support structure 34', the only difference being the manner in which the support structure is secured to faceplate 16. Consequently, like numerals have been applied where applicable.

More particularly, tension mask support structure 34 (or 34') comprises an undulated member defining peaks 60 and valleys 62, both of which are flattened as shown best in FIGS. 4, 6, 7 and 8. The support structure is formed from an elongated strip of metal material. Preferably, the material is a "Carpenter 27" chrome-iron alloy manufactured by Carpenter Technology Inc., Reading, Pa., metal which has a coefficient of expansion that substantially matches that of the glass material of faceplate 16.

Flattened tops 63 of peaks 60 are generally coplanar, as seen best in FIG. 4, to provide means for securing tension shadow mask 35 thereto, as by welding 64.

Flattened valleys 62 have flat bottom surfaces 66 which are coplanar and provide means for securing the support structure to the inside surface of fireplate 16. In the embodiment shown in FIGS. 4–6, valleys 62 of support structure 34 are secured to faceplate 16 by a hardened cement 68 (FIG. 6) which, for example, may be a devitrifying glass frit well-known in the art, or by a cold-setting cement such as a Sauereisen-type cement.

FIGS. 7 and 8 show undulated support structure 34' secured to faceplate 16 by embedding the valleys 62 of the undulated support structure partially into the glass of the faceplate when the glass is elevated to a temperature between its strainpoint and its annealing point. Copending application Ser. No. 925,424, filed Oct. 31, 1986, of common ownership herewith, discloses a process by which such an embedding securement can be achieved.

Support structure 34 (or 34') that supports the welded-on tension foil shadow mask according to the invention may comprise a continuous ring of metal, as indicated generally at 34 in FIG. 2. On the other hand, with the support structure being simply and inexpensively manufactured in an undulated configuration from a strip of metal material, the support structure can be discontinuous ("broken") or segmented, as illustrated in FIG. 3, and extending linearly along all four sides of the phosphor screen for holding the shadow mask in tension on the support structure.

While particular embodiments of the invention have been shown and described, it will be readily apparent to those skilled in the art that changes and modifications may be made in the inventive means and method without departing from the invention in its broader aspects, and therefore, the aim of the appended claims is to cover all such changes and modifications as fall within the true spirit and scope of the invention.

What is claimed is:

1. A front assembly for a color cathode ray tube including a faceplate having on its inner surface a centrally disposed phosphor screen surrounded by a peripheral area adapted to mate with a funnel, said assembly including a shadow mask support structure for securing a shadow mask in tension on the support structure and spacing the shadow mask from the screen, the support structure comprising an undulated member defining peaks and valleys, the valleys providing means for securing the support structure to the faceplate, and the peaks providing means for securing the shadow mask to the support structure.

2. The front assembly of claim 1 wherein said undulated member substantially surrounds the centrally disposed phosphor screen, and said peaks are disposed in a common plane.

3. The front assembly of claim 1, including a plurality of said undulated members substantially surrounding the centrally disposed phosphor screen, and the peaks of the undulated members are diposed in a common plane.

4. The front assembly of claim 1 wherein the peaks of said undulated member are flattened in a common plane.

5. The front assembly of claim 4 wherein the valleys of said undulated member are flattened in a common plane.

6. The front assembly of claim 5 wherein the peaks of said undulated member are flattened in a common plane.

7. The front assembly of claim 1 wherein said undulated member comprises a strip of metal.

8. The front assembly of claim 7 wherein the shadow mask is secured to the peaks of said undulated member by weld means.

9. The front assembly of claim 1 wherein the valleys of said undulated member are secured to the faceplate by a hardened cement.

10. The front assembly of claim 1 wherein the faceplate is fabricated of glass, and said undulated member is secured to the faceplate by embedding the valleys partially into the glass when the glass is at a temperature in the range between its strainpoint and its annealing point.

11. A front assembly for a color cathode ray tube including a faceplate having on its inner surface a centrally disposed phosphor screen surrounded by a peripheral area adapted to mate with a funnel, said assembly including a shadow mask support structure for securing a shadow mask in tension on the support structure and spacing the shadow mask from the screen, the support structure comprising an undulated metal member defining peaks and valleys, the valleys being flattened in a common plane to provide means for securing the support structure to the faceplate, and the peaks being flattened in a common plane to provide means for securing the shadow mask to the support structure.

12. The front assembly of claim 11 wherein said undulated member substantially surrounds the centrally disposed phosphor screen.

13. The front assembly of claim 11, including a plurality of said undulated member substantially surrounding the centrally disposed phosphor screen.

14. The front assembly of claim 11 wherein the shadow mask is secured to the peaks of said undulated member by weld means.

15. The front assembly of claim 11 wherein the valleys of said undulated member are secured to the faceplate by a hardened cement.

16. The front assembly of claim 11 wherein the faceplate is fabricated of glass, and said undulated member is secured to the faceplate by embedding the valleys partially into the glass when the glass is at a temperature in the range between its strainpoint and its annealing point.

17. A front assembly for a color cathode ray tube including a faceplate having on its inner surface a centrally disposed phosphor screen, said assembly including a shadow mask support structure characterized by an undulated cross-section and substantially surrounding the phosphor screen for supporting the shadow mask in tension upon said undulated structure, and means for securing said undulated structure to the faceplate.

18. The front assembly of claim 17 wherein said undulated structure includes peaks disposed in a common plane to provide means for supporting said shadow mask in tension upon said undulated structure.

19. The front assembly of claim 17 wherein said undulated structure includes valleys disposed in a common plane for securing said undulated structure to the faceplate.

20. The front assemble of claim 19 wherein said undulated structure includes peaks disposed in a predetermined different common plane to provide means for supporting said shadow mask in tension upon said undulated structure.

* * * * *